United States Patent [19]

Parthasarathy et al.

[11] 4,104,416

[45] Aug. 1, 1978

[54] THIN WALLED PROTECTIVE COATINGS BY ELECTROSTATIC POWDER DEPOSITION

[75] Inventors: Mellapalayam R. Parthasarathy, Verdun; Douglas C. Nethersole, Laval; Michael A. Dudley, Toronto, all of Canada

[73] Assignee: Canada Wire and Cable Limited, Toronto, Canada

[21] Appl. No.: 683,749

[22] Filed: May 6, 1976

[30] Foreign Application Priority Data

Feb. 5, 1976 [CA] Canada ..... 245068

[51] Int. Cl.[2] ..... B05D 1/06

[52] U.S. Cl. ..... 427/29; 427/27; 427/32; 427/118; 427/195; 427/202; 427/203; 427/407 R; 427/407 A; 427/407 B; 427/409; 427/410

[58] Field of Search ..... 427/25, 27, 28, 29, 427/32, 33, 195, 202, 203, 118, 201, 375, 376 R–376 H, 407 R–407 G, 409, 410, 419 R–419 G

[56] References Cited

U.S. PATENT DOCUMENTS

| | | | |
|---|---|---|---|
| 3,377,183 | 4/1968 | Hurt et al. | 427/29 |
| 3,513,012 | 5/1970 | Point | 427/27 |
| 3,708,321 | 1/1973 | Spieles | 427/29 |
| 3,814,616 | 6/1974 | Kondo et al. | 427/29 X |
| 3,824,115 | 7/1974 | Segawa et al. | 427/203 X |
| 3,937,853 | 2/1976 | Shank | 427/195 X |

OTHER PUBLICATIONS

Kut, Epoxy, "Acrylic and Polyester Thermosetting Powders are Moving Toward Practical Applications", *Metal Finishing,* Jun. 1973, pp. 41–45.

*Primary Examiner*—Ronald H. Smith
*Assistant Examiner*—Stuart D. Frenkel
*Attorney, Agent, or Firm*—Fleit & Jacobson

[57] ABSTRACT

A process for producing thin walled coatings on elongated substrates by the electrostatic application of two superimposed layers of powder material is disclosed. The process comprises the steps of applying electrostatically a first layer of fusible powder material to an elongated substrate, at least partially fusing such first layer of powder material to provide a uniform coating on the elongated substrate, holding the at least partially fused coating at an elevated temperature below the full fusion temperature of the powder material to be applied as the second layer immediately prior to the application of such second layer, applying electrostatically a second layer of fusible powder material to the first layer, and fusing the total applied coating to achieve the desired coating thickness.

20 Claims, 2 Drawing Figures

THIN WALLED PROTECTIVE COATINGS BY ELECTROSTATIC POWDER DEPOSITION

This invention relates to the production of thin walled protective coatings to elongated substrates by electrostatic powder deposition, more particularly to the production of continuous lengths of electrically insulating and/or corrosion resistant coatings on elongated substrates, such coatings being of high integrity, concentric and essentially pinhole free.

The extrusion technique has long been one of the foremost ways of coating elongated substrates. In this method, the substrate to be coated is drawn through the die opening of an extruder in which the extrudate is the material of insulation and/or protection. Consequently, the substrate is coated to a thickness depending on the size of the die opening. Due to the nature of the process, coating concentricity in the 0.002 to 0.010 in. range is difficult, primarily die to effects of drag forces acting on the extrudate between the substrate and the die surface, and central location of the substrate within the die. The processing of thermosetting materials by extrusion has also often presented problems due to the extended residence time of the material at a processing temperature which also causes precure and pre-service degradation. Other protective coating techniques such as spraying also suffer similar concentricity and thickness control problems.

The object of the present invention is to provide a process for producing, by electrostatic powder deposition, coatings on elongated substrates which have superior performance characteristics at thin film builds to coatings applied by conventional coating methods.

The process, in accordance with the invention, for producing thin walled coatings on elongated substrates through the electrostatic application of two superimposed layers of powder material comprises the steps of applying electrostatically a first layer of fusible powder material to an elongated substrate, at least partially fusing such first layer of powder material to provide a uniform coating on the elongated substrate, holding the at least partially fused coating at an elevated temperature below the full fusion temperature of the powder material to be applied as the second layer immediately prior to the application of such second layer, applying electrostatically a second layer of fusible material on the first layer, and fusing the total applied coating to achieve the desired coating thickness.

The elongated substrate may be initially preheated to a temperature below the full fusion temperature of the powder material to be applied as the first layer to increase the rate of reduction of the surface resistivity of the initial deposited powder layer.

The first layer of powder material, if fully fused, preferably has a minimum thickness of 0.001 in. representing between about 25 and 80%, preferably between 35 and 70% of the total amount of insulation to be applied to the substrate.

The second layer of powder material when fully fused preferably has a minimum thickness of 0.001 in. representing between about 20 and 75% of the total fused thickness of the coating material applied to the substrate.

In accordance with one embodiment of the invention wherein the second layer is applied by the same electrostatic coating unit as the first layer, the first layer of powder material is completely fused, then reduced to a temperature at which no deleterious deformation of the insulation on the substrate will occur by the handling equipment used to re-route the substrate, and subsequently reheated to achieve the above mentioned elevated temperature immediately prior to the application of the second layer. As an alternative embodiment, the second layer is electrostatically deposited by a second electrostatic coating unit and, in such case, the first layer of powder material is at least partially fused and maintained at a temperature below the full fusion temperature of the powder material to be applied as the second layer immediately prior to the application of such second layer.

The two applied layers may be of similar or different material and the first applied material may have a fusion temperature different from the material applied as the second layer.

The two applied layers may be made of powdered resin material selected from the following combination:

(a) thermoplastic/thermoplastic
(b) thermoset/thermoplastic
(c) thermoset/thermoset Some typical but non-limiting resin layer combinations may be as follows:

ionomer/ionomer
E-TFE/E-TFE (ethylene/tetrafluorethylene copolymer)
E-CTFE/E-CTFE (ethylene/chlorotrifluoroethylene copolymer)
epoxy/ionomer
thermoplastic urethane/thermoplastic urethane
thermoset urethane/thermoset urethane
thermoset urethane/thermoplastic urethane
nylon/nylon
epoxy/nylon
thermoplastic polyester/thermoplastic polyester
thermoset or modified polyester/thermoset or modified polyester
thermoplastic poly (vinyl chloride)/nylon
thermoset poly (vinyl chloride)/nylon.

The above described double layer coating technique has proved to produce superior quality insulation to a single layer application method where the desired thickness is achieved in a single deposition. This fact is made possible by the good wetting and spreading ability of the second applied layer over the surface of the first applied layer.

Due to the nature of the electrostatic deposition process, concentricity of coating is an inherent feature, which results in a more uniform coating at thin film builds than is attainable by the extrusion process. The process also enables the use of a wider range of coating materials than is possible with the extrusion technique, as powder fusion and flow and/or cross-linking occurs after application to the substrate.

BRIEF DESCRIPTION OF THE DRAWINGS

The invention will now be disclosed, by way of example, with reference to the accompanying non-limiting drawings in which.

DETAILED DESCRIPTION OF THE INVENTION

Application of two layers of powder material on a substrate can be achieved in two ways as follows:

1. In batch operations wherein deposition and fusion of each layer is effected in separate but similar operations. The first operation consists of a first layer film formation. The resultant product, subsequent to completion of the first batch, is then top-coated with a thin second layer of protective material in a separate operation.

Figure 1:
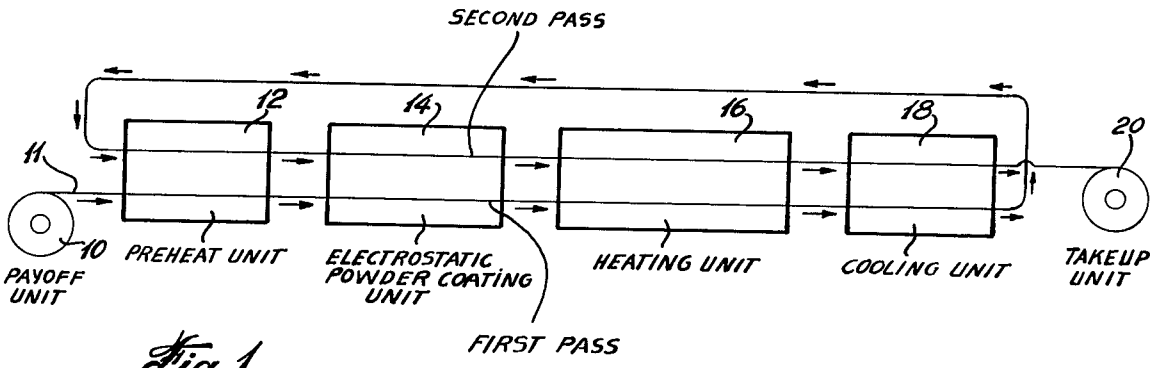
FIG. 1 illustrates a line diagram of a continuous double-layer powder coating process.
Figure 2:
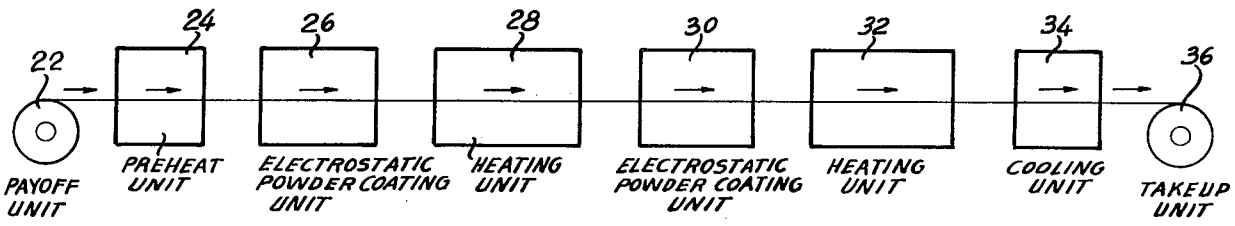
FIG. 2 illustrates a line diagram of an alternative continuous double-layer powder coating process.

2. In a single continuous operation wherein deposition and at least partial fusion of each layer is an integral part of a continuous operation. In this mode of operation, the second layer may be electrostatically deposited using the same electrostatic coating unit as for the first layer, having suitable means for independentally controlling the respective layer thicknesses, as illustrated in FIG. 1 of the drawings. The second layer may also be deposited by an apparatus separate from the first layer as illustrated in FIG. 2 of the drawings, thus permitting the possibility of different materials for each applied layer.

Referring to FIG. 1, there is shown a payoff unit 10 for paying out an elongated substrate 11 of metal or glass to be coated, a preheat unit 12 for optionally heating the substrate prior to application of the first layer of powder material and for heating the coated substrate immediately prior to application of the second layer of powder material, an electrostatic powder coating unit 14 for applying the first layer of powder material to the substrate and the second layer to the coated substrate, a heating unit 16 to effect at least partial fusion and/or cure of the applied layers of powder material, an optional cooling unit 18, and a take-up unit 20 for taking up the doubly coated substrate.

It is to be understood that these coating lines may be arranged in a horizontal manner, as shown, or in a vertical manner where space requirements or conductor size would dictate such an arrangement.

A specific but non-limiting example of the process in accordance with the invention is as follows:

A preferably grounded elongated substrate taken from the pay-off unit 10 is optionally heated in the preheat unit 12 and passed through the electrostatic powder coating unit 14 for first layer deposition. The coated substrate then enters heating unit 16, such as an oven, where at least partial fusion and/or cure of the deposited layer occurs. Subsequent to this operation, the coated substrate is passed through the optional cooling unit 18 depending on the nature of the protective layer to solidify the coating enough to avoid deleterious deformation in the substrate handling equipment. The coated substrate is then re-routed through the preheat unit 12 where it passes through the entire cycle for a second time for application of the second layer and subsequent fusion of the outer layer or layers to provide the desired coated product.

Each of the stages of the above mentioned method will now be disclosed in detail:

PREHEATING

Although preheating of the elongated substrate prior to first layer deposition is an option, it serves to improve deposition efficiency by increasing the rate of reduction of the surface resistivity of the initial deposited powder layer. The surface potential of the deposited material increases with increasing thickness to a value where the high voltage discharges through the powder layer to the substrate. From that point improper powder deposition takes place and the coating is said to have reached its "critical thickness". Preheating of the elongated substrate helps to increase the ability of the deposited layer to lose some of its acquired charge. The effect is a slower rate of increase of surface potential with increasing coating thickness and thus a higher value of the "critical thickness".

Preheating of the first layer coated substrate, prior to the second pass through the electrostatic powder deposition area is essential to ensure proper powder deposition. Without the effect of the preheat, it appears that the first deposited layer, due to its high surface resistivity, acquires a high surface potential by charge transfer from the charged particles in the electrostatic area. This results in the repulsion of some of the charged particles away from the surface of the coated substrate and thus an uneven deposition. One of the effects of preheat prior to second layer deposition is to reduce the surface resistivity of the first deposited layer thus maintaining a proper charge gradient between the charged particles and the first deposited layer. The result is a uniform second layer deposition essential to high quality protective coatings. Preheating prior to second pass also serves to reduce the surface tension of the first film layer thus enabling good powder adhesion subsequent to second layer deposition and prior to second layer fusion in the heating unit.

ELECTROSTATIC POWDER DEPOSITION

In the present invention, the process for electrostatic powder deposition may be accomplished by means of a conventional cloud coater such as the one disclosed in U.S. Pat. No. 3,396,699 issued Aug. 13, 1968. Powder material which is essentially 100% solids is kept fluidized in a bed by dry air passing through a porous base plate. Beneath the plate is an electrode, which is held, in operation, at a high potential (10–100 KV) and causes ionization of the fluidized air. A charge transfer is effected as the rising air comes in contact with the powders resulting in charging of the powders. The fluidizing effect plus the charge repulsion effect of the powder particles, result in an upward motion of the particles to form a cloud above the bed. The optionally preheated and grounded elongated substrate in the first pass and the preheated coated substrate in the second pass, passing through the cloud, are coated with a uniform deposit of the charge bearing powder. Because of the electrostatic nature of the process, the attraction and repulsion forces at play between powder particles and powder and substrate ensure that a concentric coating is obtained at all useful film thicknesses due to the formation of an equipotential surface layer. An adjustable masking mechanism is installed around the coated substrate of the second pass, inside the coating chamber, to shield part of it from the powder cloud thus enabling control of the thickness of the second deposited layer. Other suitable means of applying charged powder particles to the substrate, such as electrostatic spraying, may also be used.

FUSION OF DEPOSITED LAYERS

After the powder deposition stage, the coated substrate enters an oven which is maintained at a temperature above the melting range of the powder material. The powder deposit fuses and flows, into a smooth film, forcing out air pockets by surface tension and density effects. The oven temperature, residence time of the substrate inside the oven, and the viscosity of the molten material determine the degree of film flowout, smoothness and the degree of cure of a thermoset material.

From experimental runs performed, it has been established that for high quality protective coatings, the preferred first layer thickness if fully fused, is (i) at least 0.001 in. thick and, (ii) 25 to 80%, preferably 35 to 70% of the final desired thickness.

COOLING

Subsequent to the fusion of the film, the coated substrate may be cooled if necessary to a temperature which would ensure that minimum coating distortion occurs on subsequent contact with a film surface such as the takeup reel of the substrate handling equipment.

FIG. 2 illustrates another embodiment of the invention wherein the second layer of powder material is electrostatically deposited by an apparatus separate from the first layer deposition. The elongated substrate paid out from the payoff unit 22 may be passed through an optional preheat unit 24 as in the embodiment of FIG. 1 and is subsequently fed through an electrostatic powder coating unit 26.

The substrate emerging from the electrostatic powder coating unit 26 is fed to a heating unit 28 in which it is at least partially fused. The coated substrate leaves unit 28 in such a manner that the coating is at a temperature below the full fusion temperature of the powder material to be applied to the second layer, immediately prior to its deposition in a second electrostatic powder coating unit 30. The doubly coated elongated substrate is then fed to a heating unit 32 for fusing the total applied coating to achieve the desired thickness and thence to an optional cooling unit 34 if required to prevent deleterious deformation of the insulation before being coiled on a takeup unit 36.

The above disclosed process is very similar to the one illustrated in FIG. 1 except that two separate apparatus are provided for electrostatically depositing the two layers of powder material on the substrate. The substrate is therefore not fed back to the first apparatus for a second pass as disclosed in FIG. 1. Also different powders may be deposited for each of the layers. In such a case, the first layer of insulation is at least partially fused and then fed to the second electrostatic deposition unit at a temperature below the full fusion temperature of the powder to be applied as the second layer for application of such second layer of powder material.

The superior quality of the coating obtainable by the present invention appears to be made possible through the good wetting ability of the second applied layer on the first applied layer. All surfaces have a characteristic parameter, the "critical surface tension" which represents the maximum value of surface tension of a liquid that would spontaneously spread on the surface without beading or yielding a contact angle. All liquids having a surface tension lower than the critical surface tension of the surface in question would spread on it evenly without beading or causing pinholes. The values of surface tensions of the molten state of most fusible materials are higher than the critical surface tension of most metallic and glass surfaces. Consequently, a single layer application of powder material on an uncoated substrate often results in improper coverage of the surface due to the high total (surface) free energy of the system. However, in the double layer application, the second layer of material on being heated to its full fusion temperature would spontaneously spread across the surface of the first layer because of the similarity in surface tensions, thus resulting in complete coverage and an essentially pinhole free film. Hence, one of the purposes of the first layer in the present invention could be to act as a "primer" to initiate good wetting of the substrate by the second layer to give a high integrity coating.

Specific examples of the embodiments of this invention are given below:

EXAMPLE 1

The effect of preheat on both uncoated and first layer coated substrate is demonstrated through an example in which an ionomeric resin powder was electrostatically applied to a 25 AWG copper conductor. The coating quality was evaluated on observed coating smoothness and insulation integrity tested by passing the coated conductor through a bead chain electrode, having an applied potential of 3.5 KV AC, for 0.25 sec.

The preheat conditions investigated together with the thickness and electrical quality results are listed in Table I.

TABLE I

EFFECT OF PREHEAT TEMPERATURE ON INSULATION CONTINUITY
(Residence time under preheat = 3.2 s)

| Run No. | 1a | 1b | 1c |
|---|---|---|---|
| Preheat temp. ° C | — | 240 | — |
| First pass | — | 280 | 337 |
| Second pass | | | |
| Average coating build (in./side) | | | |
| First pass | 0.004 | 0.004 | 0.003 |
| Total thickness | 0.007 | 0.006 | 0.007 |
| Coating quality | Rough | Smooth | Smooth |
| Number of electrical failures per 3000 ft. | 3 | 0 | 0 |

The necessity for preheating or maintaining an above ambient temperature of the coated surface prior to second layer deposition is shown through the results of run No. 1*a*, which, due to the absence of preheat, resulted in improper powder deposition of the second layer. The coating obtained was rough resulting in frequent dielectric failures.

Runs 1*b* and 1*c* gave excellent results in smoothness and dielectric value of the coating due to good second layer powder deposition, made possible through the use of preheat. The temperature of the coated surface immediately prior to electrostatic application of the second layer is preferably held just below the full fusion temperature of the powder used for the second layer deposition to ensure good powder adhesion of the second layer subsequent to deposition, and prior to final fusion.

The absence of preheat of the uncoated conductor in run 1*c* confirms that preheating of the substrate prior to first layer deposition is an option.

EXAMPLE 2

In further experimental runs performed using the same powder and substrate type as in example 1, the thickness of powder deposited on the first layer was controlled to achieve levels ranging from 25 to 75% of the final thickness. Table II lists the conditions and results of such runs made where the electrical integrity was measured as described in example 1.

TABLE II

| FIRST LAYER COATING THICKNESS VS COATING QUALITY | | | | |
|---|---|---|---|---|
| Run No. | 2a | 2b | 2c | 2d |
| Average coating build (in./side) | | | | |
| First layer | 0.004 | 0.004 | 0.003 | 0.0015 |
| Total | 0.006 | 0.007 | 0.007 | 0.006 |
| Percentage of first layer thickness to total thickness | 75% | 57% | 43% | 25% |
| Max. deviation of thickness from average (%) | | | | |
| First layer | 5.4 | 3.9 | 13.8 | 50.0 |
| Total | 8.1 | 7.1 | 12.1 | 20.0 |
| Number of electrical failures per 3000 ft. | 0 | 0 | 0 | 10 |

In order to have a good second layer coverage, it is necessary to ensure that the coverage of the first layer be as uniform as possible. One of the functions of the second layer is to "fill up" the imperfections which may be present in the first layer. When the degree of coverage of the first layer falls below 95% of the total substrate surface, the efficiency of coverage by the second layer reduces correspondingly, resulting in a coating of lower protective integrity. From experimental runs performed, it has been established that for high quality protective coatings, the preferred first layer thickness, if fully fused is (i) at least 0.001 in. thick and, (ii) 35 to 70% of the final desired thickness.

EXAMPLE 3

A series of experimental runs were made utilizing both the single layer and double layer coating techniques which show the superior coating quality obtained using different polymeric powders. In the single layer method, the desired thickness was achieved by a single pass through the line. The thickness of the first layer in the double layer methods were maintained within the range of 35 to 70% of the total thickness. Both thermoplastic and thermoset materials have been used demonstrating the versatility of the process. The process conditions and results of the experimental runs are given in Tables III and IV respectively.

In all cases of using the preferred continuous double layer coating technique according to this invention, the coatings exhibited superior properties in dielectric strength.

TABLE III

COMPARATIVE PROPERTIES OF CONTINUOUS DOUBLE LAYER AND SINGLE LAYER DEPOSITION

| OPERATING CONDITIONS | 1a Double-Pass (Ionomer/Ionomer) on 25 AWG Copper | 1b Double-Layer (Epoxy/Ionomer) on 25 AWG Copper | 1c Single-Pass (Ionomer) on 25 AWG Copper | 2a Double-Pass (E-TFE/E-TFE) on 24 AWG Copper | 2b Single-Pass (E-TFE) on 24 AWG Copper | 3a Double-Pass (E-CTFE/E-CTFE) on 24 AWG Copper | 3b Single-Pass (E-CTFE) on 24 AWG Copper |
|---|---|---|---|---|---|---|---|
| Static powder depth (inches) | ¾ | ¾ | ½ | ¾ | ¾ | 1 | 1 |
| Wire height above porous plate (inches) | 3½ | 3½ | 4 | 3½ | 3½ | 4 | 4 |
| Line speed (ft/min) | 56 | 55 | 46 | 52 | 56 | 54 | 54 |
| Charging voltage (KV) | 60 | 1st layer = 43<br>2nd layer = 39 | 60 | 45 | 50 | 46 | 50 |
| Fluidizing air pressure (psi) | 15 | 1st layer = 11.5<br>2nd layer = 4 | 10 | 25 | 25 | 25 | 25 |
| Average pre-heat temperature (° C) | | | | | | | |
| 1st layer | 239 | — | | 285 | | 285 | — |
| 2nd layer | 279 | 300 (approx.) | | 337 | | 337 | — |
| Average oven temperature (° C) | | | | | | | |
| 1st layer | | | | | | | |
| Zone 1 | 263 | 235 | 203 | 410 | 355 | 243 | 242 |
| Zone 2 | 293 | 297 | 328 | 425 | 410 | 445 | 423 |
| Zone 3 | 310 | 308 | 240 | 335 | 490 | 323 | 308 |
| 2nd layer | | | | | | | |
| Zone 1 | 263 | 190 | — | 410 | — | 243 | — |
| Zone 2 | 293 | 257 | — | 425 | — | 445 | — |
| Zone 3 | 310 | 232 | — | 335 | — | 323 | — |

TABLE IV

| RESULTS | 1a Double-Pass (Ionomer/Ionomer) on 25 AWG Copper | 1b Double-Layer (Epoxy/Ionomer) on 25 AWG Copper | 1c Single-Pass (Ionomer) on 25 AWG Copper | 2a Double-Pass (E-TFE/E-TFE) on 24 AWG Copper | 2b Single-Pass (E-TFE) on 24 AWG Copper | 3a Double-Pass (E-CTFE/E-CTFE) on 24 AWG Copper | 3b Single-Pass (E-CTFE) on 24 AWG Copper |
|---|---|---|---|---|---|---|---|
| Average thickness of insulation(mils/side) | | | | | | | |
| 1st layer | 3.7 | 2.7 | 5.2 | 1.9 | 2.8 | 2.5 | 3.2 |
| 2nd layer | 6.2 | 7.0 | — | 3.8 | — | 4.9 | — |
| Maximum % deviation of thickness from average | | | | | | | |
| 1st layer | 5.4 | 14.8 | 31.1 | 25.5 | 7.14 | 60 | 68.8 |
| 2nd layer | 8.1 | 31.4 | — | 22.4 | | 20.4 | — |
| Dielectric strength test results on finished product | | | | | | | |
| No. of failures at bead electrode (0.25 second residence at KV indicated) | 0 in 3000 ft at 3.5 KV | o in 2600 ft at 3.5 KV | Continuous faulting 600 in 3000 ft at 3.5 KV | 0 in 728 ft at 2.0 KV | 6 in 56 ft at 2.0 KV | 1 in 736 ft at 2.0 KV | 17 in 108 ft at 2.0 KV |
| No. of failures | | | | | | | |

TABLE IV-continued

| RESULTS | 1a Double-Pass (Ionomer/Ionomer) on 25 AWG Copper | 1b Double-Layer (Epoxy/Ionomer) on 25 AWG Copper | 1c Single-Pass (Ionomer) on 25 AWG Copper | 2a Double-Pass (E-TFE/E-TFE) on 24 AWG Copper | 2b Single-Pass (E-TFE) on 24 AWG Copper | 3a Double-Pass (E-CTFE/E-CTFE) on 24 AWG Copper | 3b Single-Pass (E-CTFE) on 24 AWG Copper |
|---|---|---|---|---|---|---|---|
| in water (26 seconds residence time | 0 | Not tested | Not tested | 0 | Not tested | Not tested | Not tested |
| Powder adhesion to conductor prior to fusion | | | | | | | |
| 1st layer | Fair | Good | Fair | Fair | Fair-poor | Fair | Poor |
| 2nd layer | Fair-good | Fair | — | Fair | — | Fair | — |

Key:
Ionomer: DuPont Surlyn "AD5001 grade" resin.E-TFE, Liquid Nitrogen Processing "PCX-162 grade" resin.
Epoxy: Westinghouse "BT6517 grade" resin.
E-CTFE, Allied Chemicals HALAR "XP-400 grade" resin.

Although the invention has been disclosed with reference to preferred embodiments thereof it is to be understood that various modifications may be made to the process within the scope of the invention as defined in the following claims.

What is claimed is:

1. A process for production of thin walled coatings on continuous elongated substrates through an electrostatic cloud application of two superimposed layers of powder material comprising the steps of:

(a) applying electrostatically a first layer of fusible powder material to a continuous elongated substrate by passing said substrate through an electrostatic cloud coater;

(b) at least partially fusing said first layer of powder material to provide a uniform coating on the elongated substrate;

(c) holding the at least partially fused coating at an elevated temperature below the full fusion temperature of the powder material to be applied as the second layer immediately prior to the application of said second layer, said elevated temperature being sufficient to reduce the surface resistivity of the first deposited layer, thereby resulting in a uniform second layer deposition;

(d) applying electrostatically a second layer of fusible powder material to the at least partially fused first layer by passing the coated substrate through an electrostatic cloud coater; and (e) fusing the total applied coating to achieve the desired coating thickness.

2. A process as defined in claim 1, wherein the elongated substrate is initially preheated to a temperature below the full fusion temperature of the powder material to be applied as the first layer, to increase the rate of reduction of the surface resistivity of the initial deposited powder layer.

3. A process as defined in claim 1, wherein the first layer of powder material, when full fused, has a minimum thickness of 0.001 in.

4. A process as defined in claim 3, wherein the first layer of fused powder material represents between about 25 and 80% of the total fused thickness of coating to be applied to the substrate.

5. A process as defined in claim 4, wherein the first layer of fused powder material represents between 35 and 70% of the total fused thickness of coating to be applied to the substrate.

6. A process as defined in claim 1, wherein the second layer of powder material when fully fused has a minimum thickness of 0.001 in. and the fully fused second layer represents between about 20 and 75% of the total fused thickness of the coating applied to the substrate.

7. A process as defined in claim 1, wherein the second layer is deposited using the same powder coating unit as for the first layer and further comprising the step of independently controlling the respective layer thicknesses.

8. A process as defined in claim 1, wherein the second layer is deposited by a powder coating unit separate from the one used for the first layer deposition.

9. A process as defined in claim 7, wherein the first layer of powder material is completely fused, lowered in temperature to avoid deleterious deformation on the substrate handling equipment and subsequently reheated to achieve said elevated temperature below the full fusion temperature of the powder material to be applied as the second layer immediately prior to application of said second layer.

10. A process as defined in claim 1, wherein the two layers of powder material are of similar material.

11. A process as defined in claim 1, wherein the two layers of powder material are of different material.

12. A process as defined in claim 1, wherein the elongated substrate is a metal.

13. A process as defined in claim 1, wherein the elongated substrate is a glass.

14. A process as defined in claim 1, wherein the two applied layers are powdered resin material.

15. A process as defined in claim 14, wherein the two layers of resin material are thermoplastic.

16. A process as defined in claim 14, wherein the first layer of resin material is thermosetting and the second layer thermoplastic.

17. A process as defined in claim 14, wherein the two layers are thermosetting.

18. A process as defined in claim 15, wherein the two layer combination are selected from the group of thermoplastics consisting of: ionomer/ionomer, E-TFE/E-TFE, E-CTFE/E-CTFE, urethane/urethane, nylon/nylon, polyester/polyester, and poly (vinyl chloride)/nylon.

19. A process as defined in claim 16, wherein the two resin layers are the combinations: epoxy/ionomer, thermoset poly (vinyl chloride)/nylon, thermoset urethane/thermoplastic urethane, epoxy/nylon, or thermoset polyester/thermoplastic polyester.

20. A process as defined in claim 17, wherein the two layers of resin material are the thermoset combinations: urethane/urethane, polyester/polyester, modified polyester/modified polyester, or polyester/modified polyester.

* * * * *